US009295305B2

(12) United States Patent
Patel et al.

(10) Patent No.: US 9,295,305 B2
(45) Date of Patent: Mar. 29, 2016

(54) D-RING WITH RESCUE ATTACHMENT AND LANYARD ATTACHMENTS INTEGRATED

(75) Inventors: Parul Patel, Morristown, NJ (US); Shelly L. Mihalic, Morristown, NJ (US); Preston L. Anderson, Morristown, NJ (US); Douglas A. Mercier, Morristown, NJ (US)

(73) Assignee: Honeywell International Inc., Morris Plains, NJ (US)

( * ) Notice: Subject to any disclaimer, the term of this patent is extended or adjusted under 35 U.S.C. 154(b) by 139 days.

(21) Appl. No.: 13/603,802

(22) Filed: Sep. 5, 2012

(65) Prior Publication Data

US 2014/0060966 A1 Mar. 6, 2014

(51) Int. Cl.
*A62B 35/00* (2006.01)
*A44B 11/04* (2006.01)

(52) U.S. Cl.
CPC ..... *A44B 11/04* (2013.01); *A62B 35/0031* (2013.01); *A62B 35/0037* (2013.01); *Y10T 24/4764* (2015.01); *Y10T 29/49826* (2015.01)

(58) Field of Classification Search
CPC ..... A62B 35/0037
USPC ..... 182/3; 24/265 AL, 198
See application file for complete search history.

(56) References Cited

U.S. PATENT DOCUMENTS 730,726 A * 6/1903 Williams ..... 2/305
3,301,594 A * 1/1967 Pukish, Jr. ..... 297/467
3,930,288 A * 1/1976 Black et al. ..... 24/129 R
4,645,033 A * 2/1987 Oelschlager ..... 182/6
5,361,953 A * 11/1994 Nichols ..... 224/198
6,804,830 B2 * 10/2004 Reynolds et al. ..... 2/69
6,966,324 B2 * 11/2005 Guido ..... 135/120.4
8,336,503 B2 * 12/2012 Spinelli ..... 119/770
2006/0011414 A1 * 1/2006 Sundman ..... 182/6
2008/0060873 A1 3/2008 Lang et al.
2010/0326767 A1 12/2010 Guthrie et al.
2011/0214388 A1 9/2011 London

OTHER PUBLICATIONS

Brochure, SMC Mini-Rigging Plate, Rock-N-Rescue, Copyrighted 2007, Seattle Manfacturing Corp., www.rocknrescue.com/acatalog/smc-mini-rigging-plate-black.html, 2 pages.
Brochure, PETZL Small Aluminum Rigging Plate,Rock-N Rescue company, www.rocknrescue.com/acatalog/Petzl-small-aluminum-rigging-plate.html#aP63S, 3 pgs, date unknown.
(Continued)

*Primary Examiner* — Alvin Chin-Shue
(74) *Attorney, Agent, or Firm* — Craige Thompson; Thompson Patent Law

(57) ABSTRACT

Apparatus and associated methods relate to a safety interface plate element that securely attaches to a length of webbing, and further provides a plurality of non-intersecting apertures to couple to a corresponding plurality of safety devices. In an illustrative example, the safety interface plate element may include a slotted opening through which the webbing is threaded. In some examples, the webbing may be removably installed in the slotted opening via a gating mechanism. In some embodiments, the safety interface plate element configured with an embodiment of the gating mechanism may be retrofit to a closed webbing on a pre-fabricated safety harness, for example. In various examples, multiple safety devices may be securely coupled to a safety harness via embodiments of the safety interface plate element.

4 Claims, 8 Drawing Sheets

(56) References Cited

OTHER PUBLICATIONS

Brochure, Riggin Plate-TRIRIG, Rock Exotica company, www.rockexotica.com/products/rigging_plates/tririg.html, 1 pg, date unknown.

Website, Miller by Honeywell, MFLB-12/6FT TwinTurbo Fall Protection System Application, Dated Jun. 20, 2012, 1 page, millerfallprotection.com/gallery2/v/fall+protection+products/.

Website, Miller by Honeywell, Twin Turbo Exploded View-no captions, dated Jun. 20, 2012, 2 pgs, millerfallprotection.com/gallery2/fall+protection+products/.

Website, Miller by Honeywell, Turbo-lite.jpg, dated Jun. 20, 2012, 1 page, fallprotectionpros.com/media/catalog/product/cache/1/image/.

* cited by examiner

D-RING WITH RESCUE ATTACHMENT AND LANYARD ATTACHMENTS INTEGRATED

TECHNICAL FIELD

Various embodiments relate generally to fall-protection systems.

BACKGROUND

There are many occupations in which people work in dangerous environments. Working at great heights, for example, is a subset of those dangerous occupations. Some examples of such occupations are building construction, tree care, and exterior building maintenance. In addition to these dangerous occupations, many recreational activities involve working at dangerous heights, such as rock climbing and spelunking. Whenever a person is working or recreating at these heights, that person is at risk of falling.

Every year, people who work or recreate at dangerous heights fall and may suffer serious injury or death. Because of the risks, employers may provide fall-protection devices for their employees. People who recreate at dangerous heights often wear fall-protection devices as well. One purpose of these fall-protection devices is to safely arrest the fall of a person falling from a dangerous height, for example.

Fall-protection devices enable people to perform necessary work in today's building construction industry that absent that safety device few people would perform. These safety devices also permit the enjoyment of recreational activities that otherwise would be frightening. Therefore, improvements in these safety devices help save lives and improve the quality of life.

SUMMARY

Apparatus and associated methods relate to a safety interface plate element that securely attaches to a length of webbing, and further provides a plurality of non-intersecting apertures to couple to a corresponding plurality of safety devices. In an illustrative example, the safety interface plate element may include a slotted opening through which the webbing is threaded. In some examples, the webbing may be removably installed in the slotted opening via a gating mechanism. In some embodiments, the safety interface plate element configured with an embodiment of the gating mechanism may be retrofit to a closed webbing on a pre-fabricated safety harness, for example. In various examples, multiple safety devices may be securely coupled to a safety harness via embodiments of the safety interface plate element.

Various embodiments may achieve one or more advantages. For example, some embodiments may substantially separate a plurality of safety devices connected to the safety interface plate element, which may thereby advantageously reduce or avoid interferences and/or entanglements. In some safety applications, for example, some embodiments may reduce or eliminate risk of binding, for example, when a rescue hook becomes entangled or constrained by a lanyard in the event of a fall condition. In some examples, the safety interface plate element may be shaped to substantially conform to a portion of an operator's body, such as the mid or lower back region, to improve comfort and potentially reduce injury during fall impact events, for example. Some embodiments may be retrofit to an existing safety harness, which may thereby reduce the cost of replacement of the webbing to obtain the enhanced safety provided by a safety interface plate element capable of multiple connections to safety equipment. Various embodiments may yield improved accessibility to a safety rescue hook to rescue a fallen worker, for example.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1A:
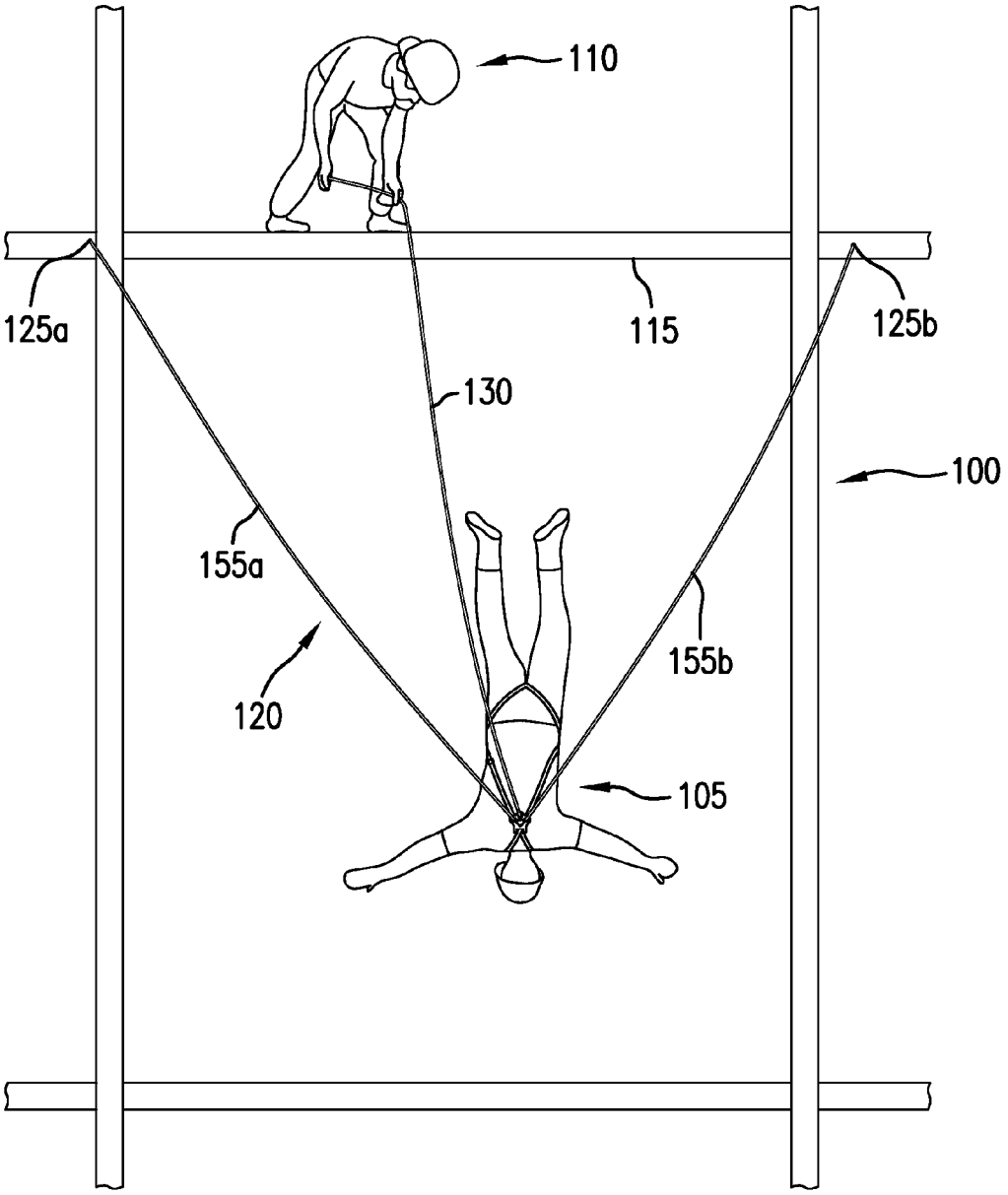
FIGS. 1*a*-1*c* depict a sketch of a field implementation of an exemplary Multi-Connector D-Ring (MCDR) used for fall protection.
Figure 1B:
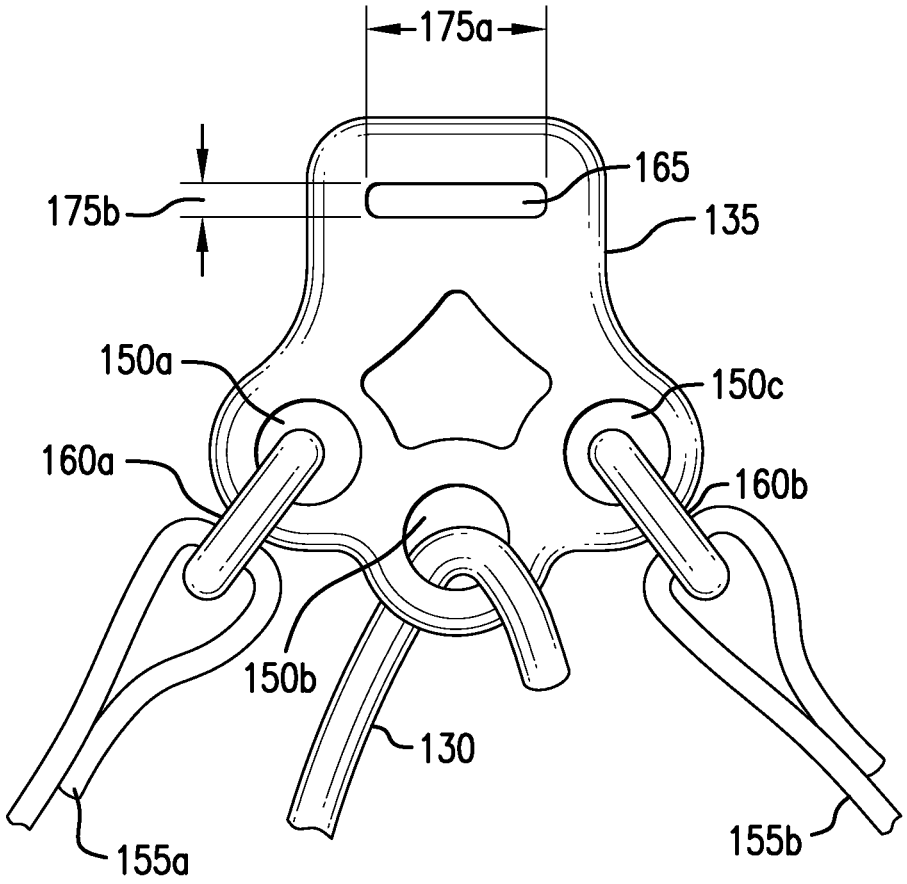
Figure 1C:
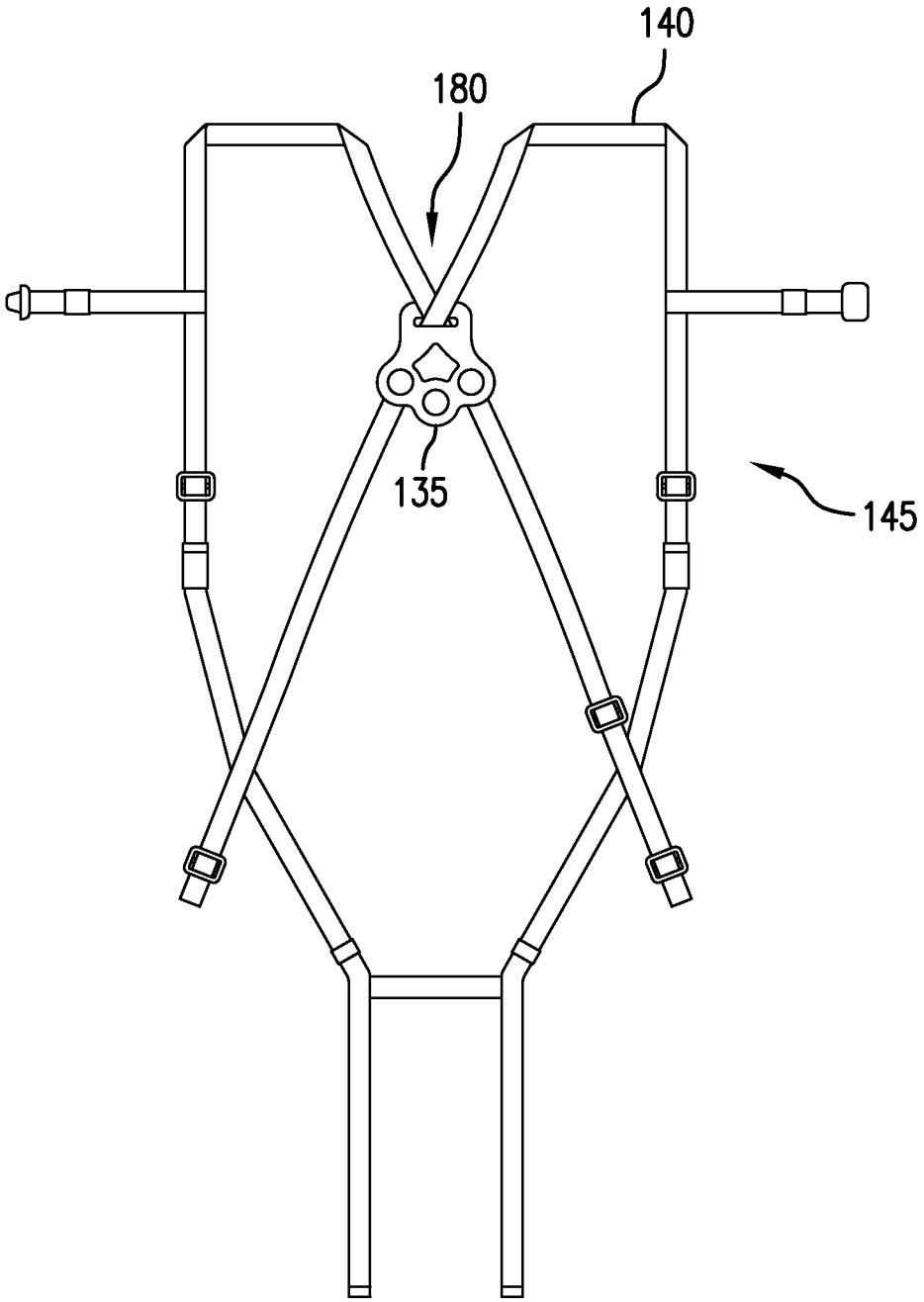

FIGS. 1*a*-1*c* depict a sketch of a field implementation of an exemplary Multi-Connector D-Ring (MCDR) used for fall protection. In FIG. 1*a* , a construction site 100 shows two workers, a fallen worker 105 and an assisting worker 110. The fallen worker 105 is connected to a steel girder 115 via a fall-protection system 120. The fall-protection system 120 has arrested the fall of the fallen worker 105 by connecting the fallen worker 105 to the steel girder 115. The fall-protection system 120 attaches to the steel girder 115 at two points of attachment 125*a*-*b*. The assisting worker 110 is using a rescue hook 130 to assist the fallen worker 105. The assisting worker 110 is attaching the rescue hook 130 to an exemplary MCDR 135, shown in FIGS. 1*b*-1*c* , the MCDR 135 being part of the fall-protection system 120. The MCDR 135 is attached to the webbing 140 of a safety harness 145, as depicted in FIG. 1*c* , which the fallen worker 105 is wearing. The MCDR 135 provides multiple device apertures 150*a*-*c* to provide connection points to multiple fall-protection safety devices, including, in this example, the two lanyards 155*a*-*b* and the rescue hook 130.

In FIG. 1*a* , the two lanyards 155*a*-*b* are connected to the MCDR 135 using two carabiners 160*a*-*b*. Because the MCDR 135 has multiple independent device apertures 150*a*-*c* , the two lanyard carabiners 160*a*-*b* and the rescue hook 130 may each be connected simultaneously and independently to different device aperture 150*a* , 150*c* and 150*b* respectively. In various embodiments, the device apertures 150*a*-*c* may be non-intersecting. In some implementations, the device apertures may be arranged to substantially prevent or reduce interference among fall-protection safety devices when connected to the MCDR 135 as depicted in detail in FIGS. 1*b*-1*c*.

As depicted in the example shown in FIGS. 1*a*-1*c* , the webbing 140 is attached to a Multi-Connector D-Ring (MCDR) 135. In the depicted embodiment, the webbing 140 passes through a webbing aperture 165. The webbing aperture 165 is sized to accommodate the webbing 140. For example, the webbing aperture 165 may have dimensions that are commensurate with those of the webbing 140. In this exemplary figure, the webbing 140 has a cross-sectional geometry of a flat belt, having both a major cross-sectional dimension (e.g., web width) and a minor cross-sectional dimension (e.g., web thickness). The webbing aperture 165 likewise has a major cross-sectional dimension 175*a* and a minor cross-sectional dimension 175*b* , both of which being slightly larger than the webbing's respective major cross-sectional dimension and minor cross-sectional dimension. These webbing aperture dimensions 175*a-b* allow the MCDR 135 to slide along a length of the webbing 140. In this example however, the webbing 140 is arranged in a cross-wise fashion so as to form cross-point 180. In this exemplary figure, the webbing cross-point 180 is located where the webbing 140 passes through the webbing aperture 165. The webbing cross-point 180, being part of the webbing 140, which in turn is part of the safety harness 145, firmly attaches to the webbing aperture 165. In this example, the length of webbing that is slidable through the webbing aperture 165 will be minimal, as the effective major cross-sectional dimension of the webbing increases in both directions away from the webbing cross-point 180.

In this exemplary figure, the MCDR 135 is not only attached to the safety harness 145 via the webbing 140, but the MCDR 135 also is attached to other devices, namely, in this figure, the two carabiners 160*a-b* and the rescue hook 130. The carabiners 160*a-b* are attached to the two lanyards 155*a-b* which in turn are secured to the steel beam 115. The first carabiners 160*a* are attached to the MCDR 135 using a first device aperture 150*a* which is sized to properly accommodate the carabiner 160*a*. The rescue hook 130 is attached to the MCDR 135 through a second device aperture 150*b* , which is sized to properly accommodate the rescue hook 130. The first and second device apertures 150*a* and 150*b* are separated one from another as they are distinct apertures separated by the material of the unitary solid body of the MCDR 135. Being separated, the carabiner 160*a* and the rescue hook 130 may advantageously avoid entanglement one to another. The first and second device apertures 150*a* and 150*b* , being sized to properly accommodate the carabiner 160*a* and the rescue hook 130 respectively, may advantageously allow the two devices to be better secured to the MCDR 135. For example, each of the apertures 150*a-c* may be sized to accommodate their intended respective connectors (e.g., carabiners, lanyards, rescue hook, etc.).

Figure 2A:
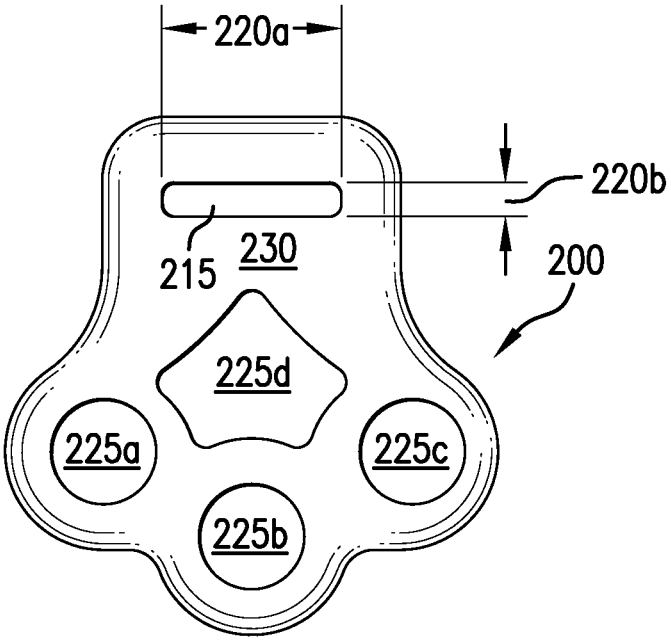
FIGS. 2*a*-2*b* show top and side views of an exemplary MCDR.
Figure 2B:
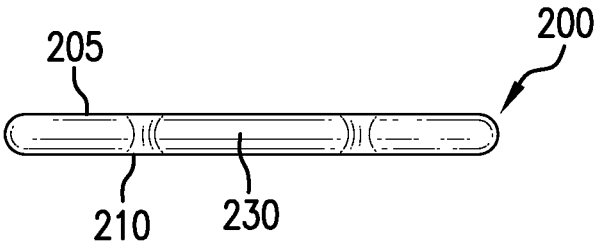

FIGS. 2*a*-2*b* show top and side views of an exemplary MCDR. As depicted, an MCDR 200 includes a top surface 205 and a bottom surface 210 that is dimensionally congruent to the top surface 205. The surfaces 205, 210 lie in parallel planes. The MCDR 200 includes a webbing aperture 215 that has dissimilar major and minor dimensions 220*a* and 220*b* respectively. Here, the major dimension 220*a* is much greater than the minor dimension 220*b*. This example's webbing aperture 215 would appropriately accommodate a webbing that is manufactured of safety-belt material having similarly related major and minor dimensions. If the webbing aperture's minor dimension 220*b* is sized to be only modestly oversized that of the webbing's minor dimension, the MCDR 200 would thus prevent the webbing from becoming twisted within the webbing aperture 215. Four additional apertures are depicted in this exemplary figure, 225*a-d*. The large central aperture 225*d* may be sized simply to reduce material and thus reduce the weight of the MCDR 200, or simply to allow a large general purpose aperture for connection to a fall-protection safety devices. Device apertures 225*a-c* in this example are all equally sized and shaped to accommodate circular device attachment. The webbing aperture 215 and the apertures 225*a-d* are formed in a unitary body 230.

Figure 3A:
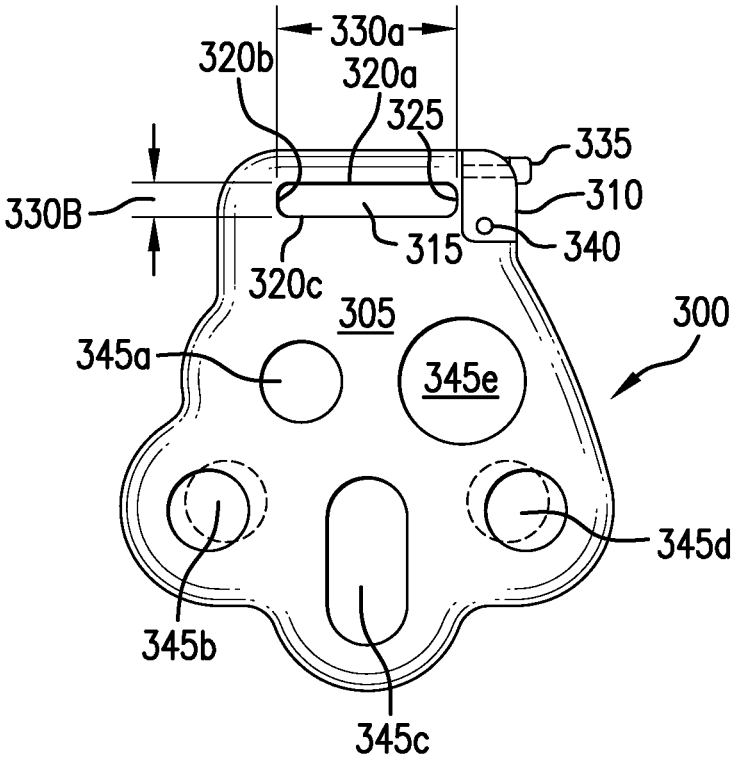
FIGS. 3*a*-3*b* show top and side views of an exemplary MCDR.
Figure 3B:
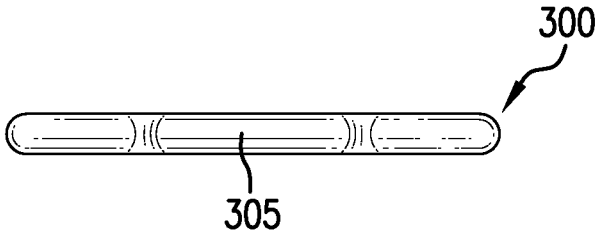

FIGS. 3*a*-3*b* show top and side views of an exemplary MCDR. This figure depicts a retrofittable MCDR 300. This exemplary MCDR 300 includes a block 305 and a gate 310. The webbing aperture 315 is circumscribed on three sides by the block's webbing aperture interior sides 320*a-c* , and on the fourth side by the gate's webbing aperture interior side 325. The resulting webbing aperture has a major dimension 330*a* and a minor dimension 330*b*. The gate may be secured to the aperture block, for example, by a fastener or screw 335. In this example the gate is opened by first disconnecting the fastener 335 and then pivoting the gate upon the hinge 340. Many functional gate technologies may well be utilized, so long as the gate may be securely closed and may be opened to accommodate a webbing. Two-action mechanisms may be used to provide the gating function, for example. Furthermore, the gate may be spring loaded and latched so as to automatically and securely close after a webbing is attached. This exemplary figure not only depicts a retrofittable MCDR 300, but it also depicts some device-aperture examples. Five device-apertures 345*a-e* are shown. Device-aperture 345*a* is a round aperture sized to accommodate a round device such as a carabiner. Device apertures 345*b* and 345*d* are also round, but in this case, the aperture is machined in a direction that is non-perpendicular to both top and bottom surfaces. This may be used to accommodate a lanyard or a cable to be used at an oblique angle, for example. Perhaps the lanyard may be used as a linear guide allowing the lanyard to freely slide through the MCDR. The device aperture 345*c* is oval. Such an oblong aperture may perhaps accommodate a device with an oval cross-section. It may also be used to allow the device some measure of play along the apertures major dimensional direction. The last device aperture 345*e* is again round but having a larger aperture area than the other device apertures 345*a-d*. In this way, dissimilar devices may be simultaneously attached to the MCDR.

Figure 4A:
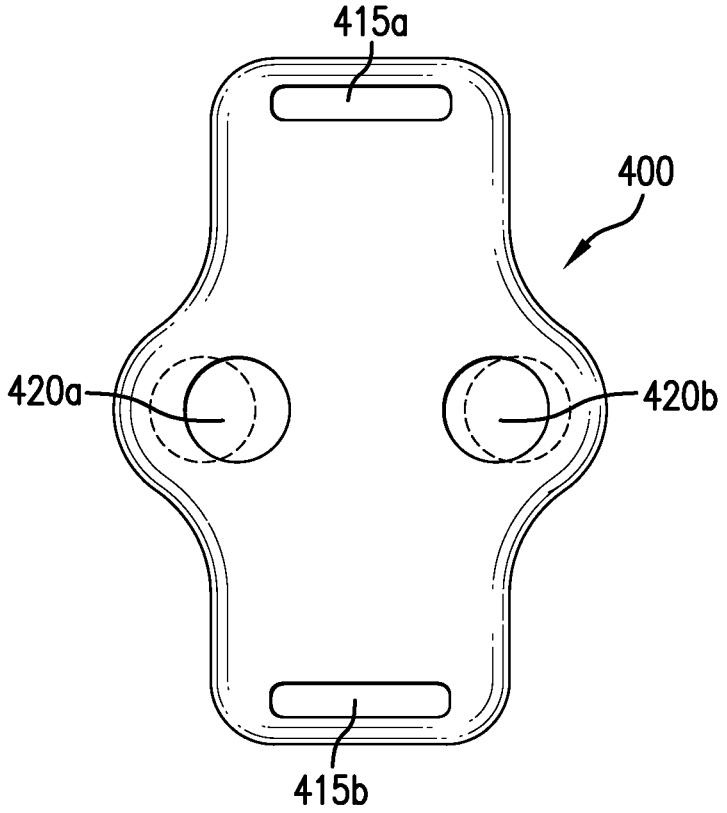
FIGS. 4*a*-4*b* show top and side views of an exemplary MCDR.
Figure 4B:
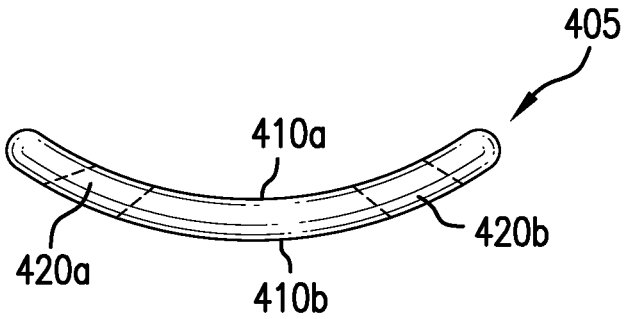

FIGS. 4*a*-4*b* show top and side views of an exemplary MCDR. The top-view of the MDCR shows the top surface 400 of the device. The side-view 405 of the MCDR shows the curvature of this example. A top surface 410*a* and a bottom surface 410*b* are shown. The MCDR may be dished to form to a body. It may also be dished so as to provide better aperture orientations relative to connecting devices. This exemplary figure depicts two webbing apertures 415*a-b* arranged in a vertical orientation. These two webbing apertures 415*a-b* combined with the curvature of the MCDR could allow for a webbing section composed of a single belt to be used in a slidable fashion. Two device-apertures 420*a-b* are shown here to be machined in a non-perpendicular orientation relative to the top and bottom surfaces 410*a-b*. This could be used to allow a lanyard or a cable to be slidable in a horizontal fashion as a guide rope, for example. In this example, the curvature may be used for the purpose to conform to a body or to provide such a slidable device attachment. The side-view 405 shows these horizontally arranged device apertures 420*a-b* as well.

Figure 5A:
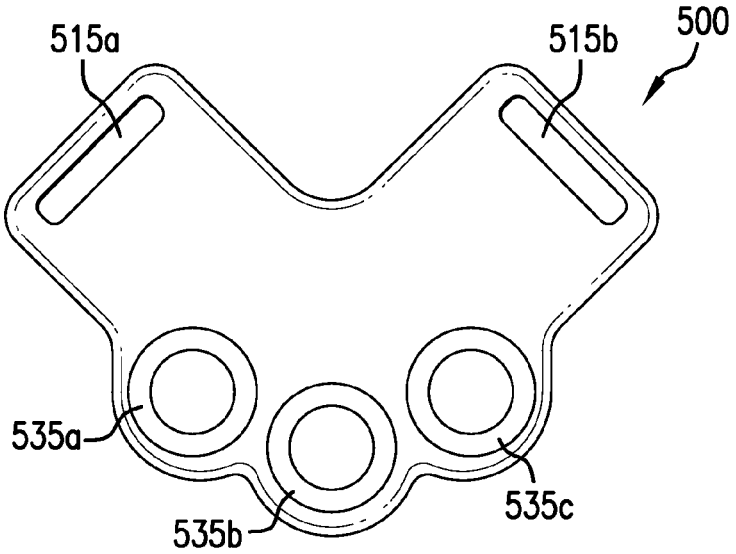
FIGS. 5*a*-5*c* show top, side, and demonstrative view of an exemplary MCDR.
Figure 5B:
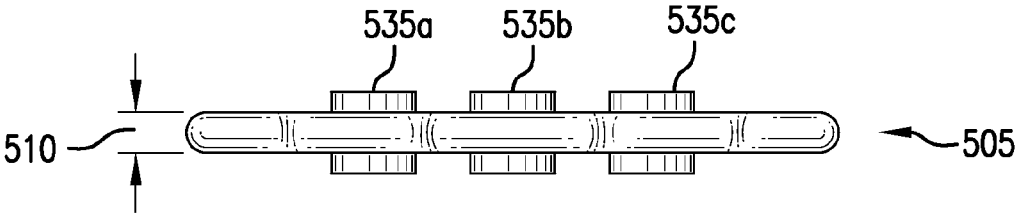
Figure 5C:
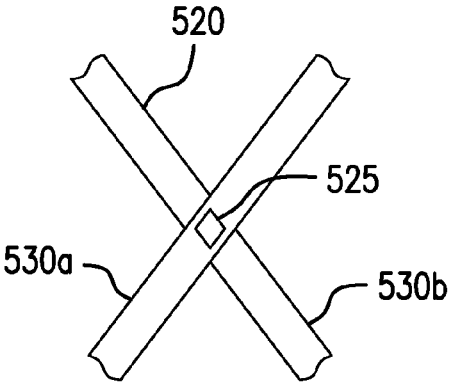

FIGS. 5*a*-5*b* show top and side views of an exemplary MCDR. This figure depicts the top-surface 500 of a planar device. The side-view 505 shows the thickness dimension 510. This example shows two diagonal webbing apertures 515*a-b*. These two apertures could allow for the insertion of a webbing 520 having a cross-point 525. The webbing 520 may be inserted into the MCDR just above the webbing's cross-point 525 so that both webbing belts 530*a-b* are diagonally attached through their respective webbing apertures 515*a-b*. This figure also depicts grommets 535*a-c* , which are located in the device-aperture holes. These grommets 535*a-c* could be made of plastic, rubber, Teflon, or another material, for example. These grommets 535*a-c* may provide more or less friction for the attached devices so that device movement may be either facilitated or inhibited. The grommets 535*a-c* could also provide for a gentler connection so that wear and tear of the device connectors is minimized Another similar implementation could encase the entire MCDR in rubber or other material.

Figure 6A:
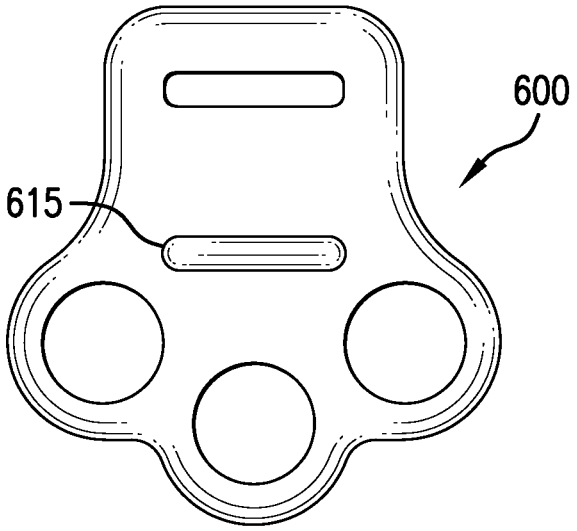
FIGS. 6*a*-6*b* show top and side views of an exemplary MCDR.
Figure 6B:
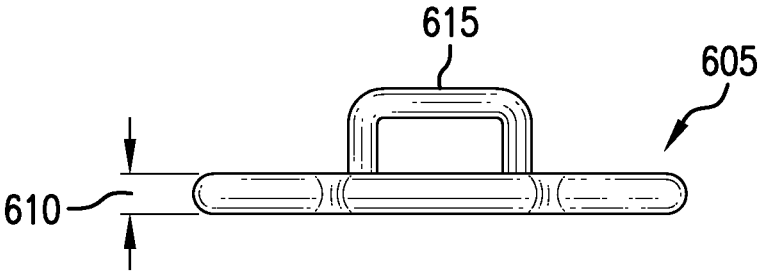

FIGS. 6*a*-6*b* show top and side views of an exemplary MCDR. This figure shows the top-view 600 of an MCDR with a planar body. The side-view 605 shows the cross-sectional dimension 610 as well as a projecting fixture 615. In this example, the projecting fixture 615 is in the form of a loop. Such a loop could facilitate the rescue of a fallen man by providing for a convenient loop for a rescue hook. The top-view 600 shows the projecting fixture 615 aligned so that the resulting loop is oriented to the top and bottom of the MCDR 600. Such a fixture perhaps allows the wearer of the MCDR protection from the rescue hook, as the body of the MCDR is interposed between the wearer and the hook.

Although various embodiments have been described with reference to the Figures, other embodiments are possible. Some embodiments, for example, may increase the separation distance between the plurality of device apertures. This may reduce the interaction of multiple carabiners with one another, for example. Carabiners typically have a mechanism that requires two actions to open. The two-action mechanism helps prevent an inadvertent and accidental opening of the carabiner. Accidental openings of fall-protection safety devices may be catastrophic. Such an event may result in the death of a construction worker or rock climber. As the wearer of a safety harness moves, the carabiners may bang each other or otherwise rattle around, if the carabiners are all secured to the same aperture. There are two hazards that arise because of this interaction. One, the fall-protection devices, which are connected to the D-ring, may become tangled up with one another. Two, the likelihood increases that one or more of the two-action mechanisms will be activated and the connector or connectors will then accidentally open. Thus, widely separated apertures will minimize the possibility of carabiner interaction.

In another embodiment, for example, the curvature of the MCDR need not simply conform to a portion of a human body, but may be used to provide better access to the apertures by providing some distance between the human body and the apertures. For example, raised portions of the MCDR may in this way provide apertures to which devices may be connected more easily and without risk of injuring the person wearing the safety harness which provides the MCDR.

In various embodiments, the apparatus and methods may involve slotted or elongated apertures, for example, to allow for linear movement of the attached device. In some embodiments, the MCDR may include two small device apertures and one large device aperture. The large device aperture may accommodate a larger attachment element, for example.

In an exemplary embodiment, the MCDR may be rubberized. This rubberized MCDR may be performed for many reasons, including wear protection, noise reduction, and comfort. The rubberized MCDR also provides the connectors with more friction so that the connector movement will be suppressed.

In accordance with another embodiment, rubberization may be performed locally in the device or webbing aperture regions of the MCDR. Rubber grommets may be used to provide such a solution. In accordance with another embodiment, Teflon may be used as grommet material to provide for a device connection with a lubricating effect. In accordance with another embodiment, plastic may be used as grommet material.

In accordance with an exemplary embodiment, titanium may be used as a material for the MCDR. In this way the MCDR may be made light without compromising the strength of the apparatus. In another exemplary embodiment, steel is used as the MCDR material.

In some embodiments that include a first and a second webbing aperture, the first webbing aperture may have a first major dimension that is different than a first major dimension of the second webbing aperture. For example, some embodiments may insert a first webbing through the first webbing aperture that has a different width than a second webbing that is inserted through the second webbing aperture.

In accordance with another embodiment, the device holes may be chamfered so as to allow the connecting device the ability to rotate in the MCDR device hole. In a similar manner, another exemplary embodiment may have chamfered webbing apertures to prevent chafing to the webbing or to allow the webbing to be slidable in the aperture. And in another exemplary embodiment, fixtures are attached to solid body portion of the MCDR. Various devices could be firmly attached to provide a variety of functions. One such example of such a device may be a shock switched lamp. Such a lamp would light up in the event of a fall.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A fall-protection D-ring apparatus for connecting a webbed safety harness to fall protection safety devices, the apparatus comprising:

a unitary solid body with a top and an opposing bottom surface, the unitary solid body comprising:

a slotted webbing aperture extending through the body between the top surface and the bottom surface, the slotted webbing aperture having a major dimension sized to receive a webbing having up to a predetermined width and having a minor dimension sized to receive the webbing's thickness such that the unitary solid body is slidable along a length of the webbing, wherein the major dimension is substantially greater than the minor dimension, wherein the minor dimension is sized to maintain the webbing in a substantially untwisted state; and said fall protection safety devices comprise:

means for simultaneously and independently connecting to at least three non-intersecting circular apertures extending through the body between the top surface and the bottom surface, wherein each of the at least three non-intersecting circular apertures receive said respective connecting means of said fall-protection safety devices; and, a fall-protection safety harness having the webbing, wherein the fall protection safety harness is securely coupled to the unitary solid body with a criss-cross point of the webbing inserted into the slotted webbing aperture.

2. The fall-protection D-ring apparatus of claim 1, wherein the at least three non-intersecting apertures comprise at least four non-intersecting apertures.

3. The fall-protection D-ring apparatus of claim 1, wherein the unitary solid body is curved to form to a portion of a human body.

4. The fall-protection D-ring apparatus of claim 1, wherein the slotted webbing aperture is integrally coupled to the webbing.

* * * * *